US009226558B2

(12) United States Patent
Armstrong

(10) Patent No.: US 9,226,558 B2
(45) Date of Patent: Jan. 5, 2016

(54) APPARATUS FOR STORING ARTICLES

(71) Applicant: Stephen G. Armstrong, Toronto (CA)

(72) Inventor: Stephen G. Armstrong, Toronto (CA)

( * ) Notice: Subject to any disclaimer, the term of this patent is extended or adjusted under 35 U.S.C. 154(b) by 0 days.

(21) Appl. No.: 14/246,624

(22) Filed: Apr. 7, 2014

(65) Prior Publication Data

US 2014/0217093 A1 Aug. 7, 2014

Related U.S. Application Data

(63) Continuation of application No. 13/928,403, filed on Jun. 27, 2013, now Pat. No. 8,746,491, which is a continuation of application No. 12/982,543, filed on Dec. 30, 2010, now Pat. No. 8,474,640.

(60) Provisional application No. 61/291,527, filed on Dec. 31, 2009.

(51) Int. Cl.

| | |
|---|---|
| ***A45C 7/00*** | (2006.01) |
| ***A45C 13/00*** | (2006.01) |
| ***A45C 13/02*** | (2006.01) |
| ***B65D 1/32*** | (2006.01) |
| ***B65D 21/08*** | (2006.01) |

(52) U.S. Cl.

CPC ..... *A45C 7/0086* (2013.01); *A45C 7/004* (2013.01); *A45C 7/0081* (2013.01); *A45C 13/008* (2013.01); *A45C 13/021* (2013.01); *B65D 1/32* (2013.01); *B65D 21/086* (2013.01); *A45C 7/0036* (2013.01); *B65D 2577/041* (2013.01)

(58) Field of Classification Search

CPC ..... B65D 2577/043; B65D 2577/042; B65D 2577/041; B65D 1/32; B65D 21/086; A45C 7/004; A45C 7/0036; A45C 7/0018; A45C 7/0081; A45C 7/0077; A45C 7/0059; A45C 7/0086; A45C 13/008; A45C 13/021

USPC ..... 220/23.89, 23.87, 23.83, 9.3, 9.2, 9.1, 220/9.4, 666, 495.06, 495.04, 495.01, 632, 220/626, 600; 190/107, 110, 125; 383/101, 383/100, 110, 109; 206/503, 216, 581, 223, 206/600

IPC ..... B65D 21/08, 25/16, 25/14, 69/00; A45C 13/03, 7/00

See application file for complete search history.

(56) References Cited

U.S. PATENT DOCUMENTS

| | | | |
|---|---|---|---|
| 2,725,087 | A | 11/1955 | Potter |
| 3,249,286 | A | 5/1966 | Palmer |
| 3,268,199 | A | 8/1966 | Kordyban et al. |
| 4,951,818 | A | 8/1990 | Johnson |
| 5,197,580 | A | 3/1993 | Berman et al. |
| 5,480,030 | A | 1/1996 | Sweeney et al. |
| 5,540,500 | A | 7/1996 | Tanaka |
| 6,135,253 | A | 10/2000 | Weissman et al. |

(Continued)

*Primary Examiner* — Robert J Hicks

(74) *Attorney, Agent, or Firm* — Adler Pollock & Sheehan P.C.; Daniel J. Holmander, Esq.; George N. Chaclas, Esq.

(57) ABSTRACT

An apparatus for storing articles comprises one or more vacuum-sealable storage bags and a container. The one or more vacuum-sealable storage bags are configured for storing the articles therein. The container configured for storing the one or more vacuum-sealable storage bags therein. The container has soft sides made of soft materials. In operation, when air within the one or more vacuum-sealable storage bags is evacuated, the one or more vacuum-sealable storage bags, and any articles stored therein, collapses into the container.

10 Claims, 14 Drawing Sheets

(56) References Cited

U.S. PATENT DOCUMENTS

| | | | | |
|---|---|---|---|---|
| 6,202,849 | B1 | 3/2001 | Graham | |
| 6,328,470 | B2 | 12/2001 | Brown et al. | |
| 6,499,571 | B1 | 12/2002 | Hays, Jr. | |
| 6,516,751 | B2 | 2/2003 | Burns et al. | |
| 7,588,160 | B2 | 9/2009 | Chen | |
| 2002/0162767 | A1 | 11/2002 | Ohtsubo | |
| 2005/0152801 | A1 | 7/2005 | Chen | |
| 2005/0155891 | A1 | 7/2005 | Chen | |
| 2006/0065500 | A1 | 3/2006 | Herrig | |
| 2006/0110079 | A1 | 5/2006 | Zimmerman et al. | |
| 2006/0151353 | A1* | 7/2006 | Wang et al. | 206/522 |
| 2008/0237239 | A1 | 10/2008 | Pham et al. | |
| 2009/0080809 | A1 | 3/2009 | Pham et al. | |
| 2011/0094933 | A1 | 4/2011 | Piazza et al. | |
| 2011/0293205 | A1 | 12/2011 | Piazza et al. | |

* cited by examiner

APPARATUS FOR STORING ARTICLES

CROSS REFERENCE TO RELATED APPLICATIONS

This continuation application is related to and claims priority from earlier filed U.S. provisional patent application Ser. No. 61/291,527 filed Dec. 31, 2009, U.S. Non-Provisional application Ser. No. 12/982,543 filed Dec. 30, 2010 now U.S. Pat. No. 8,474,640, and U.S. Non-Provisional application Ser. No. 13/928,403 filed Jun. 27, 2013, all of which are incorporated herein by reference.

BACKGROUND OF THE INVENTION

The present invention relates to a combined apparatus for storage of compressible articles. More particularly, the present invention relates to a combined apparatus for storage for compressible articles including a storage bag and a container wherein the container has soft, flexible sides.

Compressive sealable bags have been developed to reduce the volume needed to store compressible articles such as clothing, pillows, bedding, etc. Such bags have an opening through which the articles can be placed into the bag. The opening is then temporarily or permanently sealed. Air is evacuated from the bag through a one way check valve, thus compressing the compressible articles and reducing their overall volume. Not only does compressing the stored articles save storage space in suitcases, cupboards and closets, but also the removal of excess air inhibits the growth of insects and bacteria which can damage the contents of the bag, and any buildup of moisture that could cause mildew.

U.S. Pat. No. 5,540,500 illustrates one such storage bag. The bag has an open end sealed by sealing fasteners, and a flat pipe one-way check valve. Once the compressible articles are placed inside the bag and the sealing fasteners are sealed together, the bag is pressed or rolled to discharge the air contained in the bag out through the check valve. The volume of the compressed articles in the bag is significantly smaller than their uncompressed volume.

U.S. Pat. No. 5,480,030 also illustrates a compressive storage bag, having a sealable opening through which to insert compressible articles, and a one-way valve in the surface of the bag. The one-way valve is compatible with the cylindrical attachment of a household vacuum cleaner, which can be used to evacuate the air out of the bag once it is sealed.

Such compressive bags have several shortcomings. Compressible articles often do not compress down into a flat shape, making it difficult to stack multiple compressive bags on top of each other without toppling over. Further, compressed bags stored over long periods of time may allow air to slowly leak back into the bags, thus resulting in a slowly expanding volume of storage space taken up by the compressed bag. Moreover, compressive bags are made from a pliable plastic film that can be punctured with rough handling or by contact with sharp objects. The plastic film material can also lose its vacuum sealing integrity as it ages. Thus, articles stored over long periods of time could expand in volume and lose the vacuum protection from the bag, possibly without being detected for some time.

There is a need for a sealable compressive container that stores compressible articles in a stackable manner, provides superior protection against accidental puncture, and will not expand even if the vacuum integrity of the container is compromised.

BRIEF SUMMARY OF THE INVENTION

An embodiment of the present invention preserves the advantages of prior art combined apparatus for storage. In addition, it provides new advantages not found in currently available combined apparatus for storage and overcomes many disadvantages of such currently available combined apparatus for storage.

The present invention is a combined apparatus for storage for storing compressible or other articles. The combined apparatus including a combination of an expandable, air-tight storage bag and a soft-sided container for storing the storage bag therein. In one embodiment, the combination of the storage bag and the soft-sided container being stackable.

The storage bag defines an opening at a top end for inserting compressible articles into an interior of the storage bag. The storage bag having at least one snap strip member made of ABS plastic positioned along the opening of the bag for repeatedly opening and closing the defined opening at the top end of the storage bag to form an air-tight seal. A valve for facilitating removal or entry of air from an interior of the storage bag installed within a surface of the storage bag.

The soft-sided container having four side walls, a top portion, and a bottom portion defining a compact and low profile when in a collapsed state. The soft-sided container defines an opening therein. The soft-sided container including a fastening means for repeatedly attaching or detaching the top portion to said four side walls to open or close the container.

A base support member is releasably attached to the bottom portion of the container. The four side walls, the top portion, and the bottom portion, and the base support member made of soft, flexible or bending materials. At least one securing member is attached to the bottom portion of the container.

In operation, as air within the storage bag is evacuated from the storage bag through the means for facilitating removal or entry of air from an interior of said storage bag, the storage bag and the compressible articles stored therein collapse into the soft-sided container.

It is therefore an object of the present invention to provide a combined apparatus for storage including a storage bag and a container wherein the container has soft, flexible sides.

It is a further object of the present invention is to provide a combined apparatus for storage with a low profile in a compressed state.

It is also an object of the present invention to provide a combined apparatus for storage which is lightweight and easy to store when not in use.

Another object of the present invention is to provide a combined apparatus for storage which is capable of storing articles of various shapes and dimensions.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the combined apparatus for storage are set forth in the appended claims. However, the combined apparatus for storage, together with further embodiments and attendant advantages, will be best understood by reference to the following detailed description taken in connection with the accompanying drawings in which:

DETAILED DESCRIPTION OF PREFERRED EMBODIMENTS

As outlined in detail in the attached invention disclosure and materials, a new and novel system for a combined apparatus for storage is disclosed. As illustrated in FIGS. 1-15, the present invention provides an evacuatable, combined apparatus for storage 100A, 100B. More particularly, the present invention relates to a combined apparatus for storage for compressing articles including a storage bag 200 and a container 300 wherein the container 300 has soft, flexible sides. The combined apparatus for storage saves storage space, provides superior protection for the stored compressed articles, and conveniently stores an uncompressed volume far exceeding the volume of the storage unit.

Figure 1A:
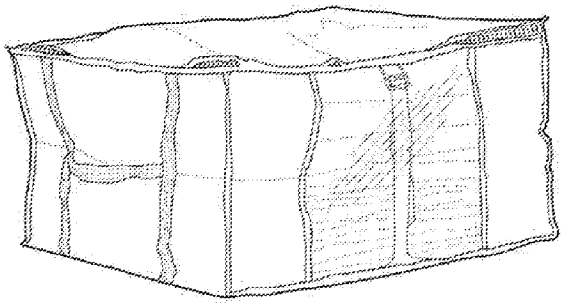
FIG. 1A is a perspective view of a combined apparatus for storage.
Figure 1B:
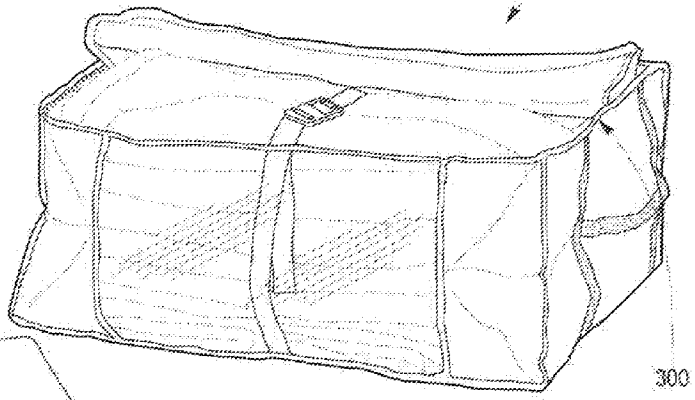
FIG. 1B is a perspective view of another combined apparatus for storage.
Figure 2:
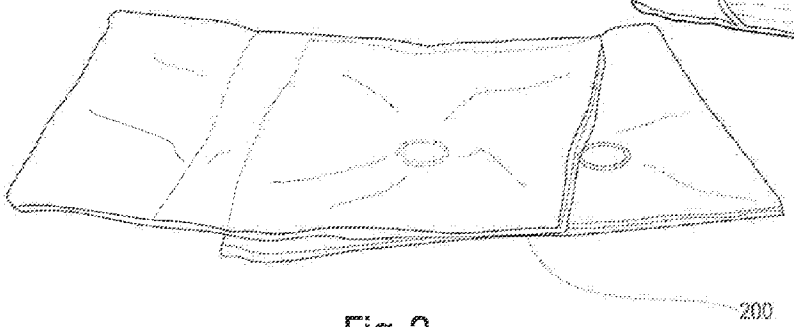
FIG. 2 is a perspective view of storage bags for nesting within a container of the combined apparatus for storage.

Referring to FIGS. 1A-2, the present invention is a combined apparatus for storage of compressible articles, such as common household items including bedding and clothing. The combined apparatus includes a combination of an expandable, storage bag 200 and a container 300 for storing the bag therein. The combination of the bag 200 and the container 300 is configured for stacking, similar to a box.

Figure 3:
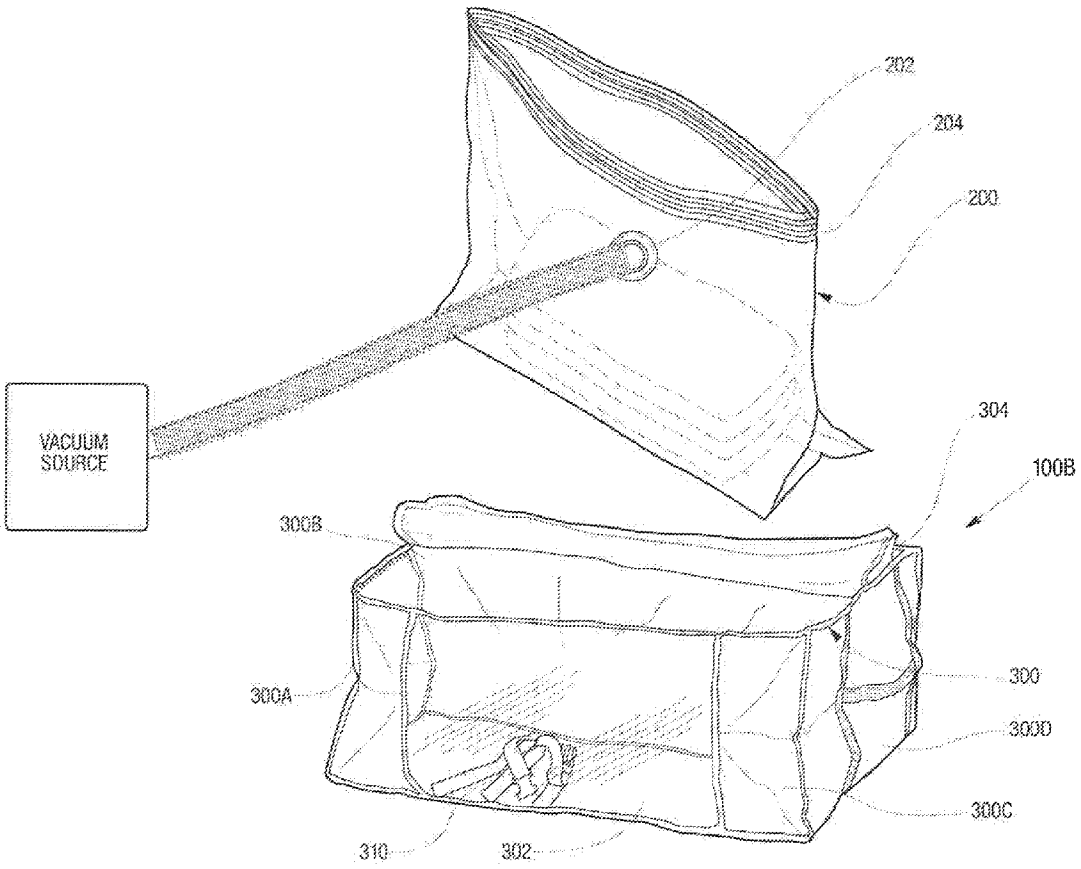
FIG. 3 is an exploded view of the combined apparatus for storage of FIG. 1B.
Figure 4:
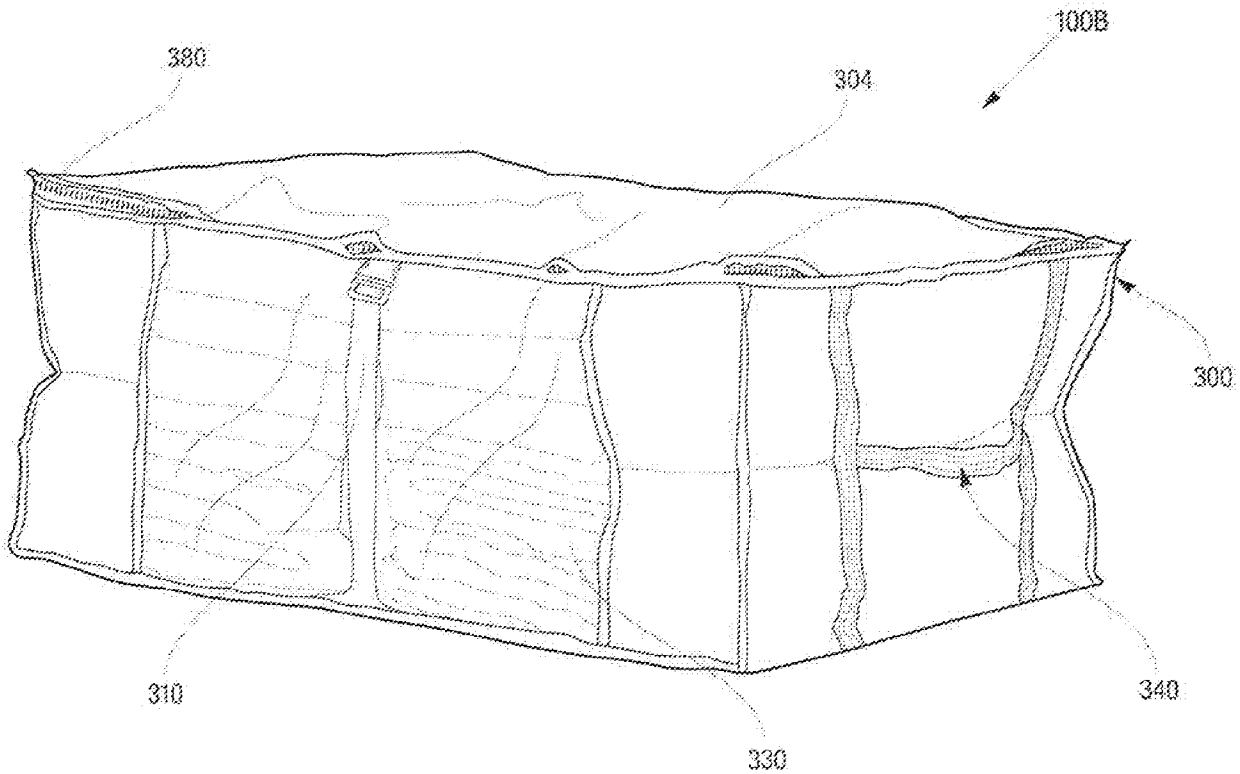
FIG. 4 is a perspective view of the combined apparatus in a closed position for storage of FIG. 1B.
Figure 5:
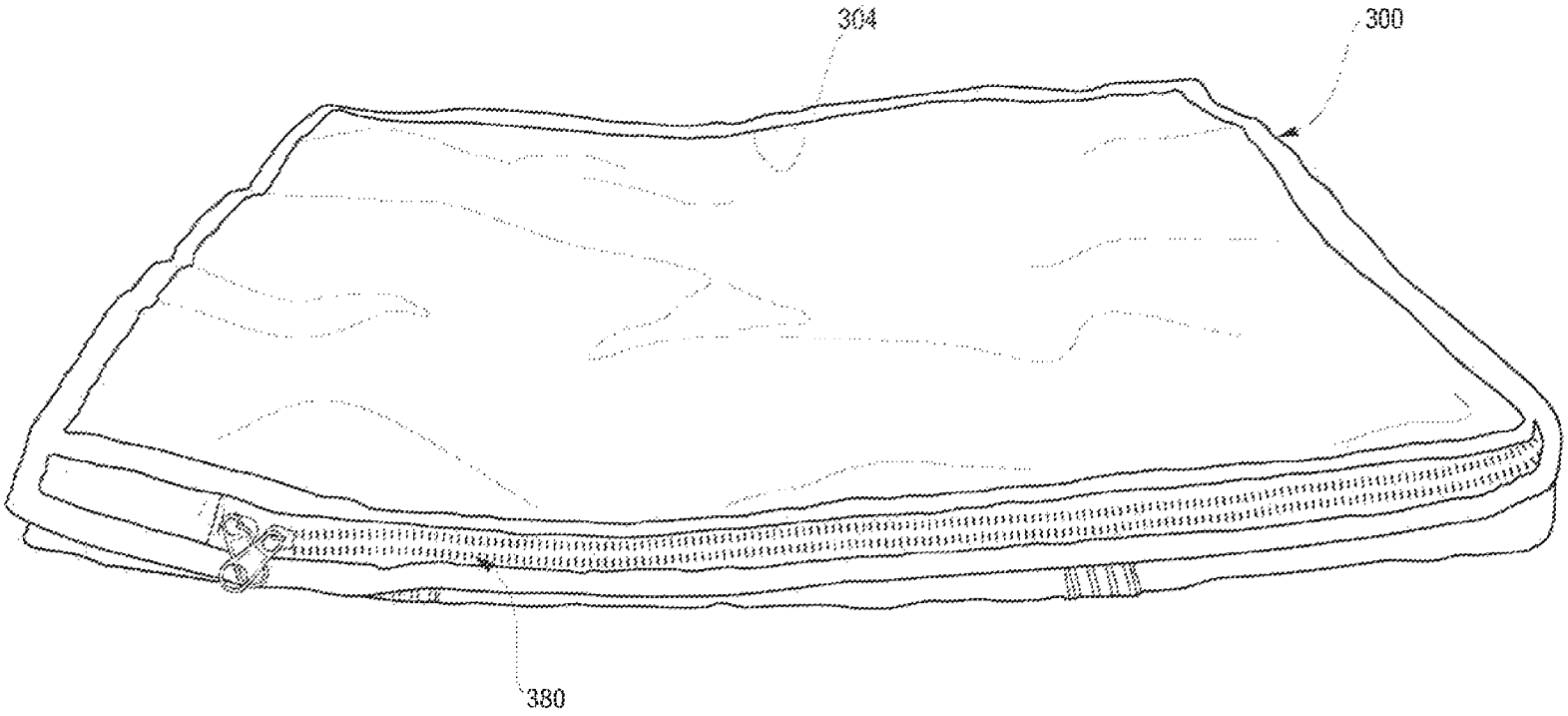
FIG. 5 is a side view of the combined apparatus for storage of FIG. 1B in a collapsed, low-profile state without the storage bag therein.

Referring to FIG. 3, in one embodiment, the container 300 is a reusable tote and the storage bag 200 is a vacuum-sealable, air-tight, water-proof, reusable, compression bag. The container 300 or bag 200 may generally define a cube-shape. Of course, it is contemplated that the container 300 and/or the bag may defined shapes other than cube-shapes, such as square 100A of FIG. 1A or rectangular 100B of FIG. 1B or other shapes. The storage bag 200 is made of clear, pliable layers of nylon film or similar materials. The bag 200 is made of any flexible material that is impervious to air, such as O-nylon, C-nylon, polyethylene, bi-axial nylon, polyurethane, polyester, PET, polypropelene, etc. The storage bag 200 defines an opening at a top end for inserting compressible articles into an interior of the storage bag 200.

The storage bag 200 has a means for providing an air-tight and water-tight seal at an opening of the bag 200 at one end. In one embodiment, the means for providing an air-tight and water-tight seal is at least one snap strip member 204 made of ABS plastic or other plastic materials positioned along the opening of the bag for closing the opening of the bag 200. The at least one snap strip member 204 also provides a means for repeatedly opening and closing the opening of the bag 200.

The storage bag 200 having a means for removing air from an interior of the bag 200. The means for removing air from an interior of the interior includes a one-way valve 202 made of polyethylene positioned within an aperture on the bag 200. The one-way valve 202 may be positioned on the bag 200 at a selected location. There are a variety of well-known one-way air valves available on the market that can be installed within the bag 200 to allow air flow in only one direction. Overall, the bag 200 is configured to contain an article extracted of air while being housed or seated within the container 300.

Referring to FIGS. 4-15, the container 300 defines an opening between at least two opposing sides. In one embodiment, the container 300 has four side walls 300A-D. More specifically, the container 300 may have four side walls that include two long sides and two short sides. Of course, the sidewalls may also be equal in length or size or different in length or size to define different shapes or sizes. The container 300 also includes a top portion 304 and a bottom portion 302 whereby the four side walls and, top portion, and bottom portion define a compact and low profile when in a collapsed state. The container 300 is made of polyethylene material or woven nylon or similar flexible or soft materials. Of course, materials other than listed may be used for the present invention.

Figure 6:
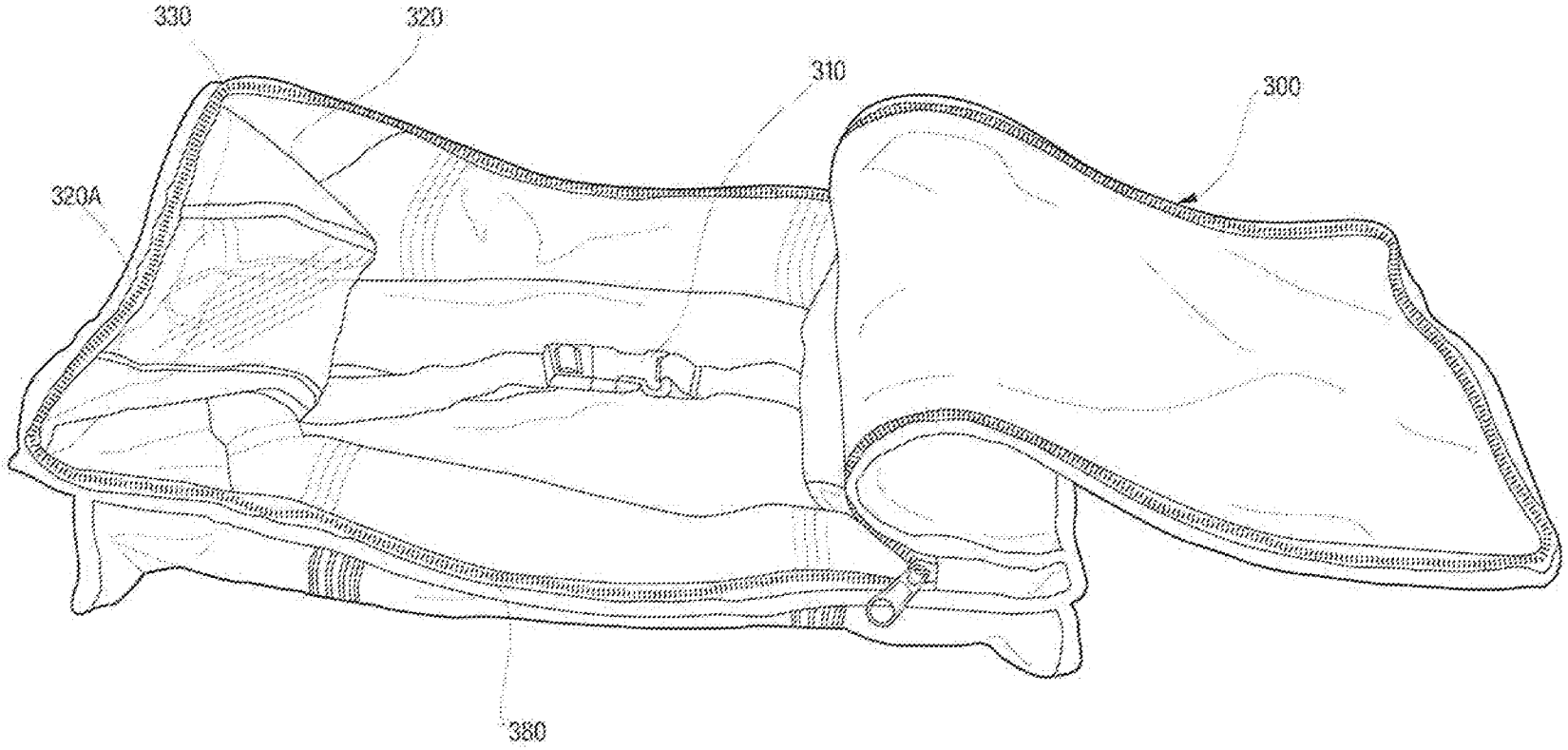
FIG. 6 is a top perspective view of the combined apparatus of FIG. 5 in an open position.

Referring to FIG. 6, the container 300 has a means for repeatedly opening and closing the opening of the container 300. In one embodiment, the means for repeatedly opening and closing the opening is the top portion or cover releasably attached at or near the opening of the container 300. In one embodiment, the top portion has a flat zipper 380 for releasably attaching the top portion to the container 300 at or near the opening of the container 300. Of course, it is contemplated that velcro or other fastening means may be used other than a flat zipper for releasably attaching the top portion to the opening of the container 300.

Figure 7:
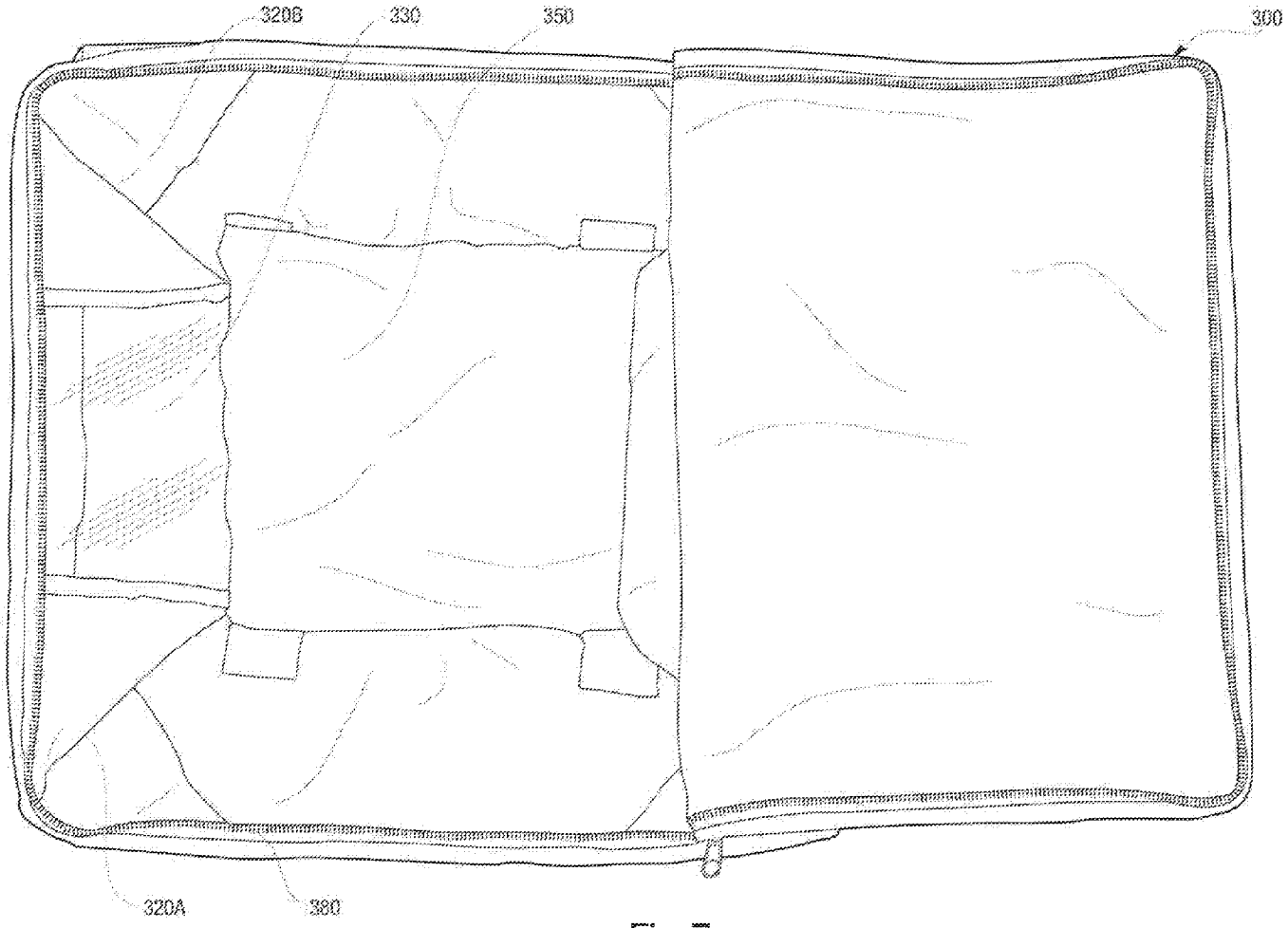
FIG. 7 is a top view of the present invention of FIG. 5.

Referring to FIG. 7, the container 300 includes at least one or more triangular-shaped, buttress supports 320A, 320B attached to an inner surface of the container 300 to provide support to the container 300. At least one of the side walls has at least one transparent window 330 made of clear plastic materials. In one embodiment, one of the short sides includes the transparent window.

Figure 8:
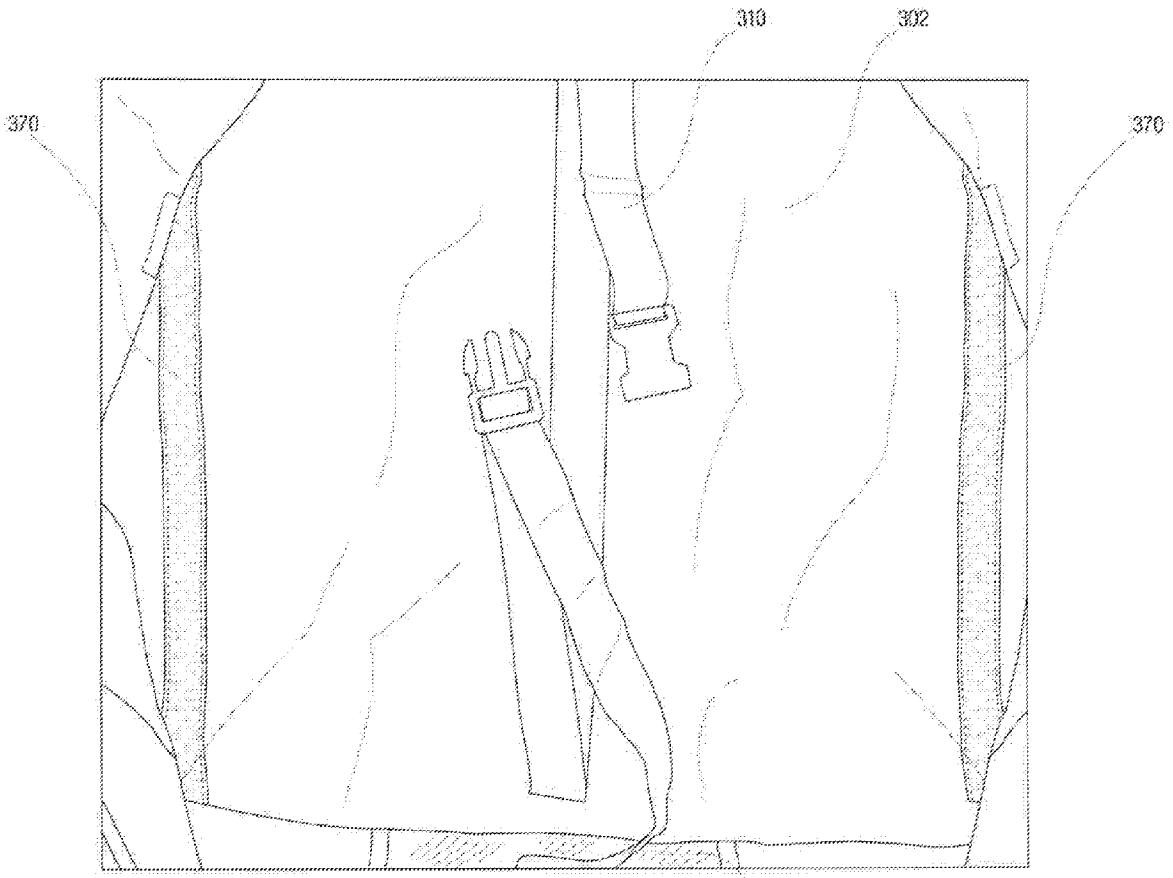
FIG. 8 is a partial top view of FIG. 5 in an open position.
Figure 9:
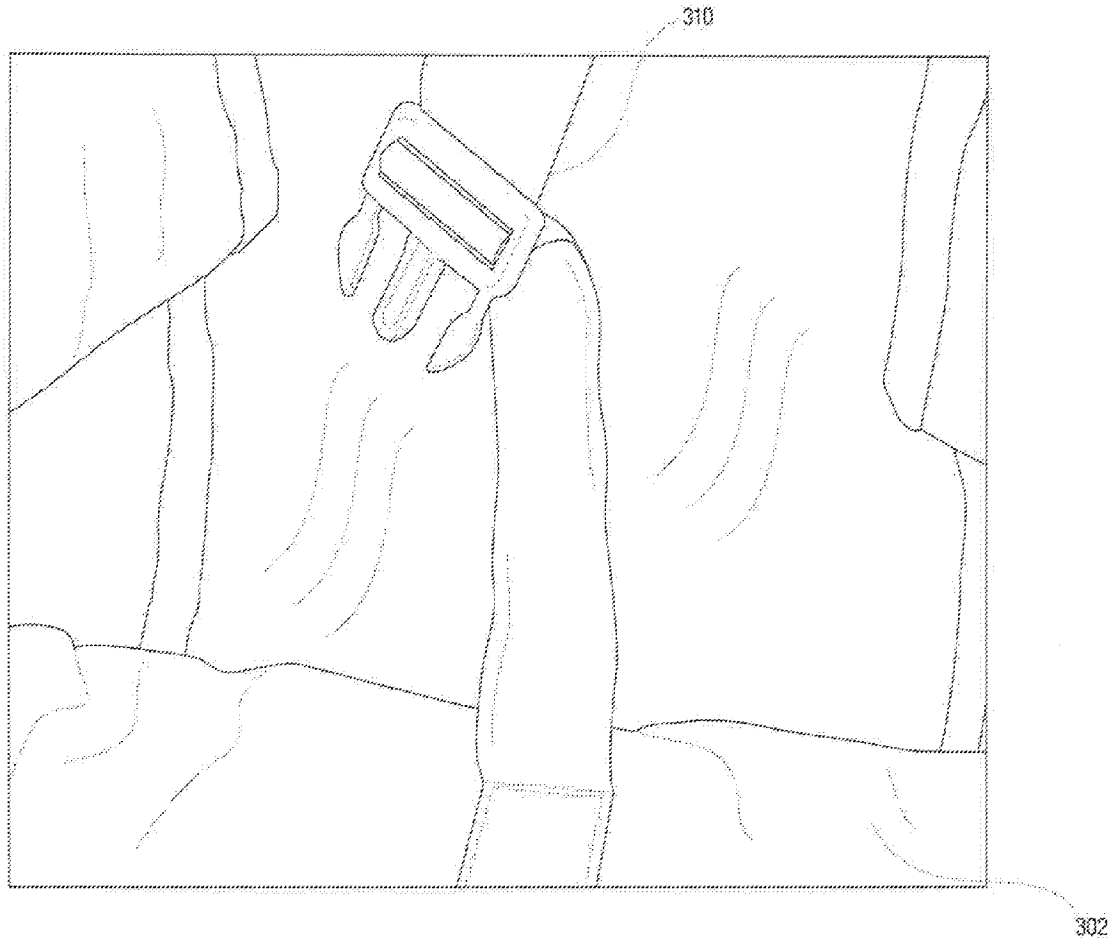
FIG. 9 is an isolated view of the present invention of FIG. 8 showing a securing member attached to the bottom portion of the container.
Figure 10:
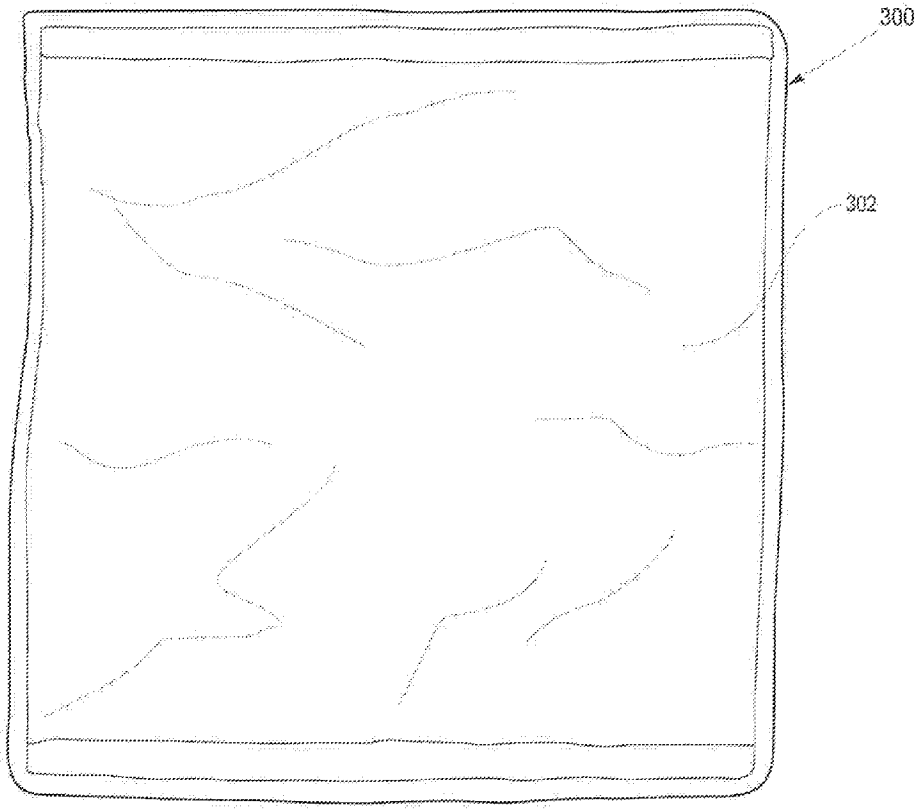
FIG. 10 is a bottom view of FIG. 5.

Referring to FIGS. 8-9, at least one securing member 310 is attached to the bottom portion of the container 300. At least one securing member is sewn or stitched into an inner surface of the bottom portion 302. The at least one securing member is a binding ribbon or buckling belt which run across the base support member and are capable of enclosing the bag 200 above. The at least one securing member may have a portion disposed between a base support member 350 and the bottom portion of the container 300 and another portion positioned above the base support member 350. In another embodiment, the at least one securing member is releasably attached to the bottom portion of the container 300 using fastening means known in the art or omitted altogether.

Figure 11:
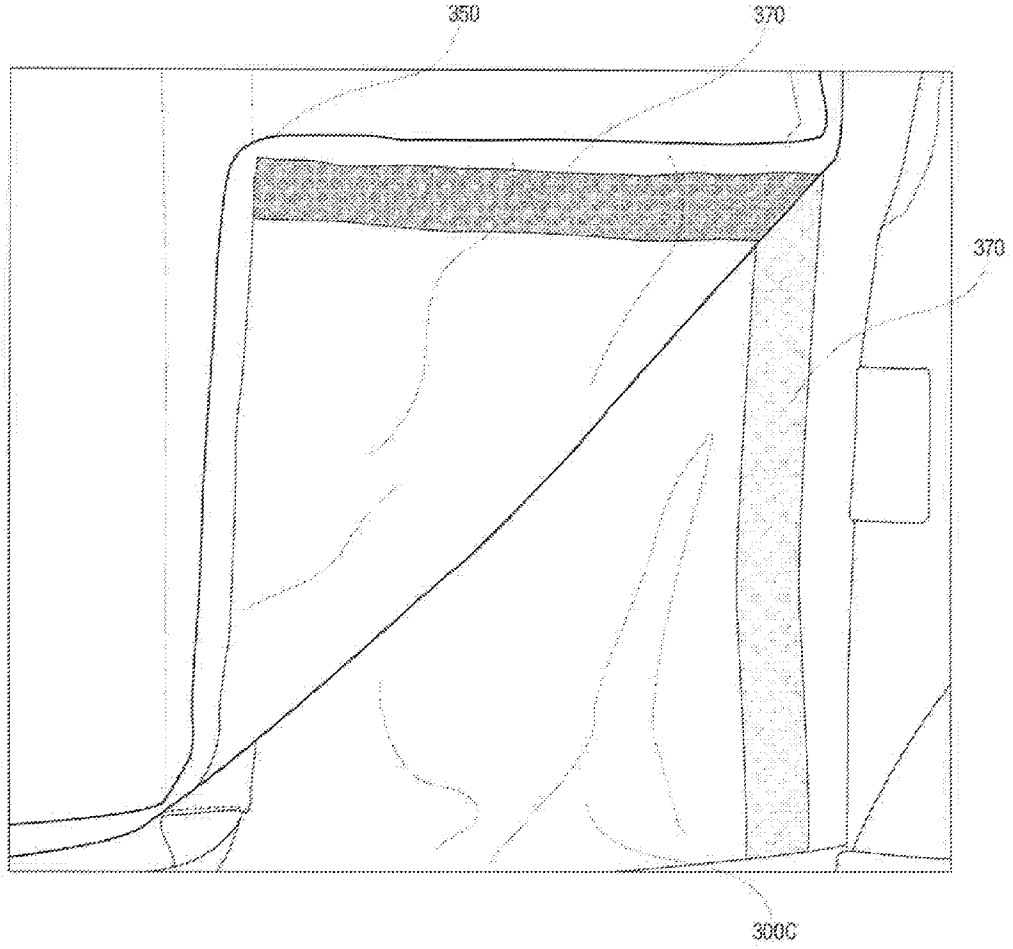
FIG. 11 is an isolated view of FIG. 5 showing the base support member releasably attached to the bottom portion of the container.
Figure 12:
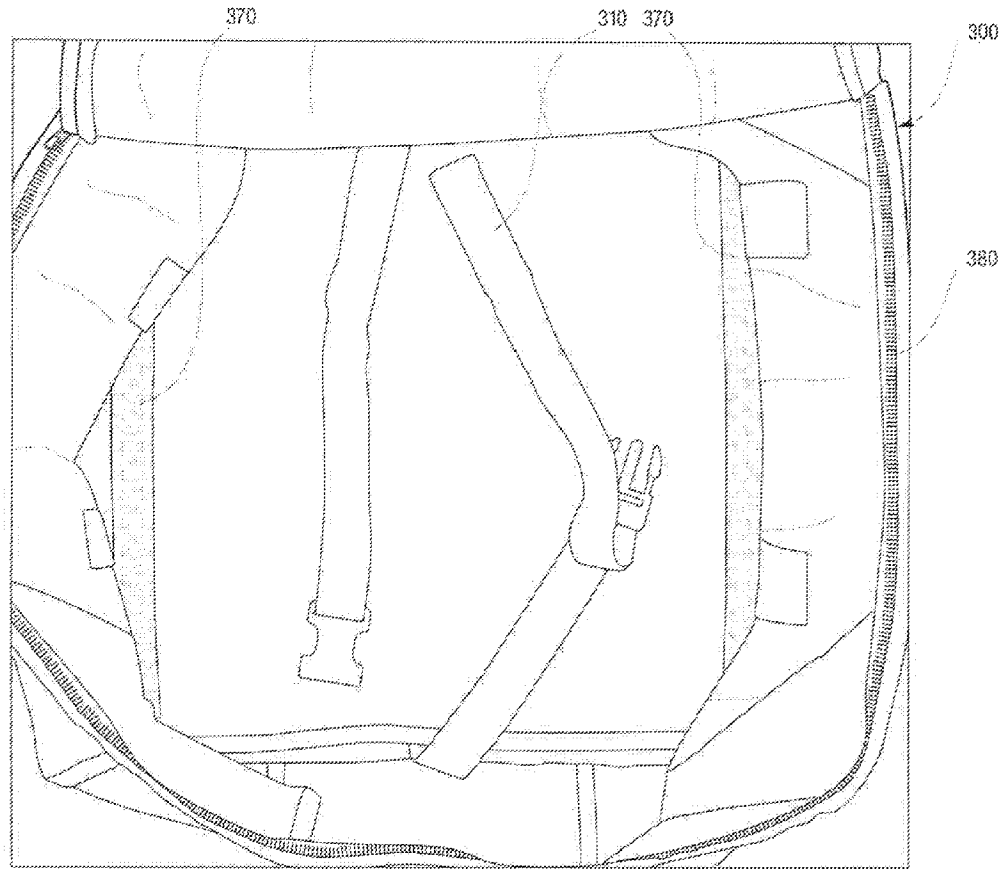
FIG. 12 is a top view of FIG. 5 in an open position.
Figure 13:
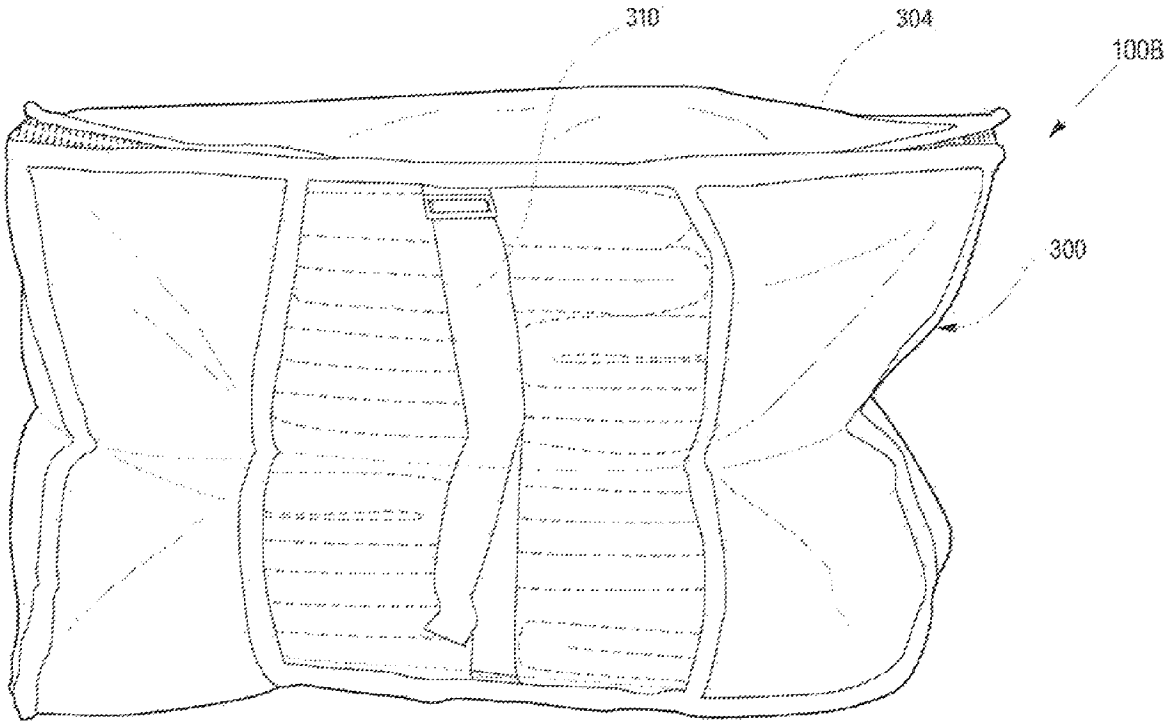
FIG. 13 is front view of the present invention of FIG. 1B in a closed position.

Referring to FIGS. 11-12, the base support member 350 is releasably attached to the bottom portion of the container 300. In one embodiment, the base support member and the bottom portion of the container 300 are releasably engaged together using velcro strips 370. In one embodiment, the velcro loops are sewn into the bottom side portion of the container 300 and the velcro hooks are sewn into the base support member. Of course, it is contemplated that the velcro hooks may be sewn into the bottom side portion of the container 300 and the velcro loops may be sewn into the base support member. In addition, the base support member and the bottom portion of the container 300 may be releasably engaged using other types of hook-and-loop fasteners and other fastening means such as buttons, laces, buckles, zippers and similar.

The base support member generally defines a shape and dimension substantially similar to the bottom portion of the container 300 and substantially covers the bottom portion of the container 300. The long sides, short sides, top portion, bottom portion, and base support member are soft-side and made of soft or flexible materials, in other words, not rigid or stiff and do not require the insertion of a ridged member therein. In another embodiment, the base support member may be attached permanently to the bottom portion of the container 300 directly by sewing the base support member to the bottom portion of the container 300. In another embodiment, the base support member is optional and may be omitted.

Figure 14:
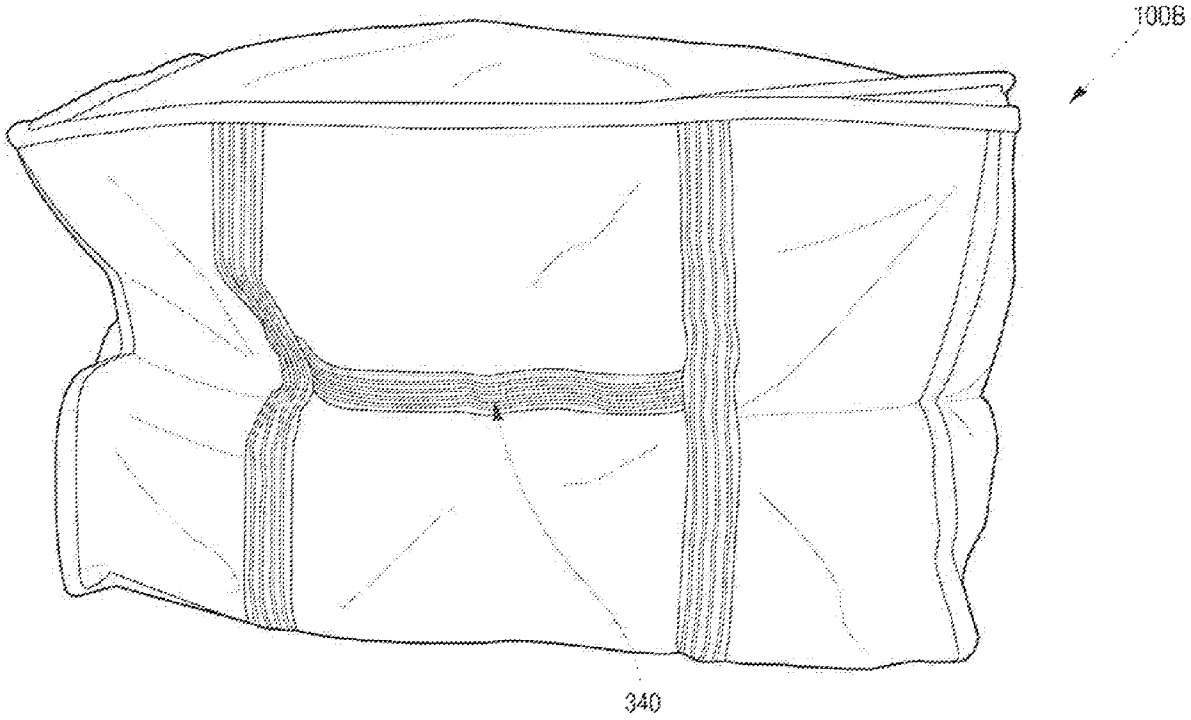
FIG. 14 is a side view of the present invention of FIG. 1B in a closed position.

Referring to FIG. 14, the container 300 also includes at least one handle member 340 attached to at least one side wall of the container 300. In one embodiment, the container 300 has at least one handle member sewn or stitched along at least one long side. Of course, the handle can be attached to either the long side or the short side if desired. In one embodiment, the handle member includes a horizontal strap portion for engaging a user's hand and two vertical strap portions which are attached along an outer surface of the side wall and the bottom portion extending from near an opening of the container 300 to the bottom portion.

Figure 15:
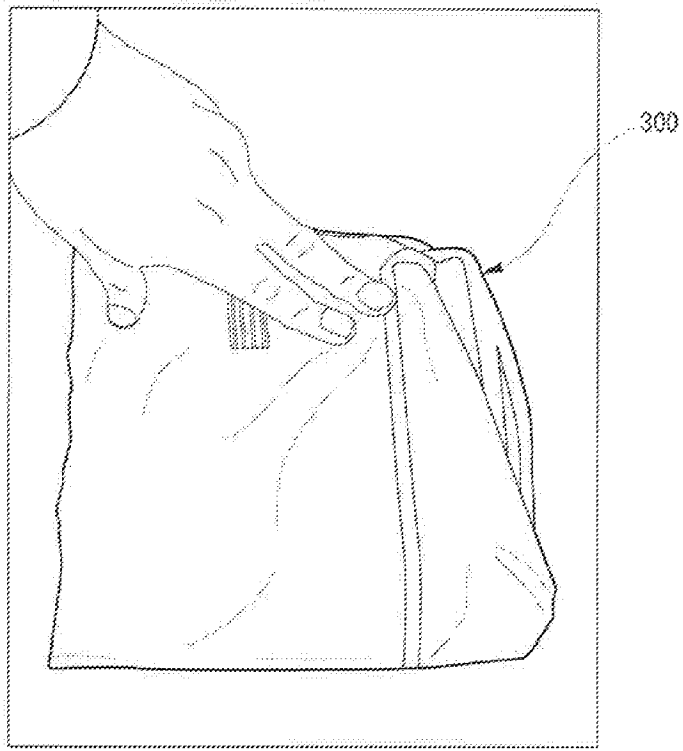
FIG. 15 is a top view of FIG. 5 in a folded state for easy storage.

Referring to FIG. 15, the container 300 is shown folded into a compact state for easy storing when not in use. The soft-sides of the container 300 allow the user the flexibility to fold up the container 300 into a smaller, compact state which reduces the space needed for storing away and making it easier for transporting. In addition, the soft-sided container 300 allows compressible articles or other objects to be placed inside the combined apparatus that have a greater accommodation of various sizes and dimensions in comparison to rigid containers of the prior art. The soft-sides of the container 300 allow the sides of the container to bulge out or bend in flexible manner to fit the article inserted into the combined apparatus for storage.

In use, referring to FIG. 3, an article, such as bedding or clothing pillows, blankets, bedding, sweaters, comforters, sleeping bags, jackets, parkas, skiing or hunting clothes, stuffed animals, foam cushions, life vests, etc or any other compressible or non-compressible article, is stored in the storage bag 200. The storage bag 200 is then sealed after combining the snap strip members and vacuumed by a vacuum source. A vacuum source may be a common household vacuum cleaner. When the vacuum source is activated, air is withdrawn from the bag 200 thus compressing the bag 200, and the articles stored therein. If no vacuum source is available, the bag 200 can be evacuated of air manually by pressing the liner down and into the container 300. Alternatively, a force may be applied by a variety of methods to the storage bag 200 to manually move the air through the one-way air valve and out of the storage bag 200. The one-way valve in the aperture prevents air from re-entering the bag 200. A sealing cap can be screwed or snapped onto the aperture to increase the long term vacuum integrity thereof. The storage bag 200 is placed within an interior of the container 300 (either before, during, or after the storage bag 200 is evacuated), the top portion is zippered or closed, and the bag 200 is bound by connecting the at least one securing members together. The top portion is then secured or releasably engaged to the open end of the container 300 to secure the storage bag 200 therein. Since the combined storage apparatus is boxy in overall dimension and profile, it is easier for the combined storage apparatus to be stored or stacked.

Once the storage bag 200 is secured within the container 300, the articles, and the bag 200, are all protected by the flexible container 300. If for some reason the air tight integrity of the bag 200 is compromised and air leaks back into bag 200, the container 300 and top portion attached securely thereto will help contain the compressed articles inside the volume of the container 300.

In summary, as air within the storage bag 200 is evacuated from the storage bag 200 through the means for facilitating removal or entry of air from an interior of said storage bag 200, the storage bag 200 and the compressible articles stored therein collapse into the soft-sided container 300.

In one embodiment, by way of example only, the container 300 may include the following dimensions: 15¾ inches length×16 ½ inches width and 10 inches height and 25½ inches length×20 inches width×11 inches height. Of course, this is only an example and there may be other width and height dimensions of the combined apparatus for storage. It should also be noted that the combined apparatus for storage may or may not be stackable depending upon the dimensions of the combined apparatus for storage and the compressible articles disposed therein. It should be also noted that in the preferred embodiment the storage bag 200 is nested within the container 300 but it may also be possible to use the bag 200 and container 300 separately.

It would be appreciated by those skilled in the art that various changes and modifications can be made to the illustrated embodiments without departing from the spirit of the present invention. All such modifications and changes are intended to be within the scope of the present invention.

What is claimed is:

1. An apparatus for storing articles, consisting of:

a container configured for storing one or more vacuum-sealable storage bags therein, the container having two or more soft walls; and one or more vacuum-sealable storage bags configured for storing the articles therein, the storage bag configured to collapse within the container.

2. The apparatus of claim 1, wherein the one or more vacuum-sealable storage bags are made of at least one of: O-nylon, C-nylon, polyethylene, bi-axial nylon, polyurethane, polyester, PET, and polypropylene.

3. The apparatus of claim 1, wherein each one or more vacuum-sealable storage bags has a one-way valve positioned within an aperture defined on the respective bag.

4. The apparatus of claim 1, wherein the container further comprises:

at least one triangular-shaped buttress support attached to an inner surface of the container.

5. The apparatus of claim 1, wherein: at least one of the soft walls of the container has a transparent window.

6. The apparatus of claim 1, wherein each vacuum-sealable storage bag has a means for providing an air-tight and water-tight seal.

7. The apparatus of claim 1, wherein the two or more soft walls of the container are: four side walls, a top portion, and a bottom portion.

8. The apparatus of claim 7, further comprising: at least one securing member attached to the bottom portion of the container for enclosing a vacuum-sealable bag positioned on the bottom portion.

9. The apparatus of claim 1, wherein the container further comprises a means for repeatedly opening and closing the container.

10. The apparatus of claim 1, wherein the container further comprises:

a bottom portion; and a base support member releasably secured to the bottom portion.

* * * * *